US005976341A

United States Patent [19]

Schumacher et al.

[11] Patent Number: 5,976,341

[45] Date of Patent: Nov. 2, 1999

[54] PROCESS AND APPARATUS FOR ELECTROLYTIC DEPOSITION OF METAL LAYERS

[76] Inventors: Rolf Schumacher, Paderborner Straβe 7 E, Berlin, Germany, D10709; Wolfgang Dahms, Hermsdorfer Straβe 53 A, Berlin, Germany, D13437; Reinhard Schneider, Alte Fürther Staβe 37, Cadolzburg, Germany, D-90556; Walter Meyer, deceased, late of Berlin, Germany, by Helga Meyer, heir; Helga Meyer, Klosterheider Weg 18, Berlin, Germany, D-13467; Silke Kaftanski, Jasminweg 10, Winkelhaid, Germany, D-90610; Petra Fromme, Elsenpfuhlstr. 13, Berlin, Germany, D13437

[21] Appl. No.: 08/507,499

[22] PCT Filed: Dec. 23, 1994

[86] PCT No.: PCT/DE94/01542

§ 371 Date: Apr. 22, 1996

§ 102(e) Date: Apr. 22, 1996

[87] PCT Pub. No.: WO95/18251

PCT Pub. Date: Jul. 6, 1995

[30] Foreign Application Priority Data

Dec. 24, 1993 [DE] Germany ..... 43 44 387

[51] Int. Cl.[6] ..... C25D 21/18

[52] U.S. Cl. ..... 205/101; 205/125; 205/920; 204/237; 204/232; 204/275

[58] Field of Search ..... 205/101, 99, 88, 205/148, 125, 920, 292; 204/237, 232, 275

[56] References Cited

U.S. PATENT DOCUMENTS

| | | | |
|---|---|---|---|
| 4,270,984 | 6/1981 | Giner et al. | 205/63 |
| 4,789,439 | 12/1988 | Bunk et al. | 205/101 |
| 5,262,020 | 11/1993 | Masante et al. | 205/559 |
| 5,304,297 | 4/1994 | Tench et al. | 205/101 |
| 5,312,539 | 5/1994 | Thomson | 205/101 |

FOREIGN PATENT DOCUMENTS

| | | |
|---|---|---|
| 3100635 | 1/1982 | Germany . |
| 3110320 | 1/1982 | Germany . |
| 215589 | 11/1984 | Germany . |
| 261613 | 11/1988 | Germany . |
| 59-170299 | 9/1984 | Japan . |
| 61-048599 | 3/1986 | Japan . |

*Primary Examiner*—Kathryn L. Gorgos
*Assistant Examiner*—Kishor Mayekar

[57] ABSTRACT

A process and apparatus for electrolytically depositing a uniform metal layer onto a workpiece is provided. The workpiece, for example a circuit board, serves as a cathode. The anode is insoluble and dimensionally stable. Both anode and cathode are immersed in a plating solution contained in an electrolytic container. The solution includes (a) ions of the metal to be deposited on the workpiece, (b) an additive substance for controlling physical-mechanical properties of the metal to be deposited, such as brightness, and (c) an electro-chemically reversible redox couple forming oxidizing compounds when contacting the anode. A metal-ion generator is provided, supplying metal parts of the metal to be deposited onto the workpiece; The plating solution is circulated between the container and the ion generator for maintaining a reaction between the oxidizing compounds and the metal parts for forming metal ions. The plating solution is controllably re-circulated into the container so that a low concentration of the oxidizing compounds is present in the plating solution adjacent to the workpiece.

19 Claims, 6 Drawing Sheets

PROCESS AND APPARATUS FOR ELECTROLYTIC DEPOSITION OF METAL LAYERS

BACKGROUND OF THE INVENTION

1. Field of the Invention

The present invention relates to a process and an apparatus for electrolytic deposition of uniform metal layers, preferably of copper, having given physical-mechanical properties.

2. Description of the Related Art

The electrolytic metallization, for example with copper, of workpieces which are electrically conductive at least on their surface, has been known for a long time. The workpieces which are to be coated are connected as cathode and, together with anodes, brought into contact with the electrolytic plating solution. For the deposition, a flow of electric current is produced between anode and cathode.

Generally, anodes made of the same material as the plating solution are used. The amount of metal deposited from the solution is returned to the plating solution by dissolving at the anodes. In the case of copper, the amount deposited and the amount which is anodically dissolved are approximately the same for a given charge flow. This process is easy to carry out because when copper is used, only sporadic measurement and control of the metal-ion concentration of the plating solution is necessary.

However, disadvantages have been encountered when carrying out the process with these soluble anodes. If the thickness of the metal layers deposited is to be very uniform on the surface of the workpiece, then the soluble anodes are only conditionally suitable for this purpose, because soluble anodes change shape with time due to the dissolving, so that the distribution of the lines of force in the electrolytic bath also changes. The use of smaller, for example spherical pieces of metal as anodes in insoluble metal baskets is also only conditionally suitable for solving the problem, because the metal parts frequently wedge against one another and as a result of the dissolving process, gaps are frequently formed upon the sliding down in the pile of metal parts.

Therefore, attempts have frequently been made to use insoluble, and therefore dimensionally stable anodes, rather than soluble metal anodes, for example, titanium or high-grade steel. Using these anode materials, gases, such as oxygen or chlorine, are formed upon the electrolytic deposition since the anodic dissolving of metal no longer takes place. The gases produced attack the anode materials and gradually dissolve them.

German Patent DD 215 589 D5, describes a process for the electrolytic deposition of metal which uses insoluble metal anodes and to which reversibly electrochemically convertible substances are added to the plating solution. These substances are being transported by intense positive convection with the plating solution to the anodes of a plating apparatus. They are converted electrochemically by the electrolysis current, and then guided by intense positive convection away from the anodes into a regeneration space, returned electrochemically to their initial condition in the regeneration space on regeneration metal present in it with simultaneous electroless dissolving without external current of the regeneration metal, and fed in this initial condition again to the separation apparatus by intensive positive convection. In this process, the above-discussed disadvantages associated with the use of insoluble anodes, are avoided. Instead of the corrosive gases, the substances added to the plating solution are oxidized at the anode, so that the anodes are not attacked.

The dissolving of the metal in the regeneration space is in this case independent of the process of the deposition of metal on the material being treated. Therefore, the concentration of the metal ions which are to be deposited is controlled by the effective metal surface in the regeneration space and by the velocity of flow in the circuit. In the case of a deficiency of metal ions, the effective metal surface and/or the velocity of flow from the deposition space to the regeneration space is increased or, in case of an excess of metal ions, correspondingly reduced. This process therefore presupposes that a high concentration of the reversibly electrochemically convertible substance is present in the plating solution. This results in oxidized compounds of the addition substances (redox system) being again reduced at the cathode, so that the current efficiency is decreased.

German Unexamined Application for Patent DE 31 10 320 A1 describes a process for cation reduction by anode-supported electrolysis of cations in the cathode space of a cell, the anode space containing ferrous ions as reducing agent and anodes that are moved relative to the anolyte which surrounds the anodes.

German Unexamined Application for Patent DE 31 00 635 A1 describes a process and an apparatus for supplementing an electroplating solution with a metal to be precipitated in an electroplating apparatus, wherein the metal which is to be galvanically precipitated is provided in an electroplating solution. The electroplating solution is contained in an electroplating container and a supply of the metal to be precipitated is provided within an enclosed space. Gases produced in the electroplating container upon the advance of the electroplating process are guided, together with the electroplating solution, into the enclosed space and applied there to the supply of metal in order to dissolve the latter. Then, the dissolved supply of metal is again added to the electroplating solution in the electroplating container. The apparatus required for carrying out of the process is, however, very expensive, because it must be gas-tight.

However, the discussed processes have the disadvantage that the plating solutions to be regenerated contain no additives, which, are generally required in order to control the physical-mechanical properties of the deposited metal layers. Such substances are predominantly organic substances.

It is only by these additives that the required physical-mechanical properties of the layers such as, for example sufficient brightness, high elongation upon rupture, and resistance of the layer to cracks upon soldering shock tests are obtained. Without the addition of these additives, the layers are dark, dull, and rough.

DD 261 613 A1 describes a process for the electrolytic deposition of copper from acid electrolytes with dimensionally stable anode using certain additives for the production of layers of copper having specific physical-mechanical properties. The plating electrolyte also contains the aforementioned electrochemically reversibly convertible additives.

Although the quality of the metal layers precipitated from such plating solutions are initially satisfactory, in particular with regard to the physical-mechanical properties, it has been found that after a longer period of deposition, layers of poorer quality are obtained. This is the case even if the substances in the plating solution, whose concentration was decreased by consumption upon the deposition are supplemented. Copper coatings which are only poorly ductile are obtained from used plating solutions. This causes tearing of layers on printed circuits in the region of the drill holes when they are subjected to a soldering shock test. Further, the surface of the metal layer also changes in that it becomes dull and rough.

SUMMARY OF THE INVENTION

It is an object of the present invention to eliminate the disadvantages of the the prior art by providing an economical process and suitable apparatus for the electrolytic deposition of layers of metal, particularly of copper, in which the metal layers have predetermined physical-mechanical properties, and by including additives to the plating solution for controlling the properties of the metal layers, by which the properties of the metal layers do not change disadvantageously even after a lengthy period of deposition. Furthermore, the thicknesses of the metal layers are about uniform on the surface of the material treated, and the deposition is possible with high current efficiency.

To obtain sufficiently uniform layer thicknesses on the surface of the treated material, insoluble and dimensionally stable anodes are used. In order to supplement the metal ions consumed by deposition, for example, copper ions, a metal-ion generator is used containing parts of the metal to be deposited. The plating solution also contains compounds of an electrochemically reversible redox couple. For regenerating the plating solution which has become diminished by consumption of metal ions, the plating solution is passed along the anodes, whereby the oxidizing compounds of the redox couple are formed. Thereupon, the solution is guided through the metal-ion generator, which provides for the oxidizing compounds to react with the metal parts and to form metal ions. At the same time, the oxidizing compounds of the redox couple are converted into the reduced form. By forming the metal ions, the total concentration of the metal-ion concentration in the plating solution is maintained constant. From the metal-ion generator, the plating solution passes back again into the electrolyte space which is in contact with the cathodes and anodes.

The solution also contains additive compounds for controlling the physical-mechanical properties of the layer. In order to maintain the properties of the layer even after a lengthy period of deposition from the plating solution, the invention provides means by which the concentration of the oxidizing compounds of the redox couple in the direct vicinity of the cathode can be minimized, preferably to a value below about 0.015 mole/liter.

Obviously, the additive compounds can be decomposed by the oxidizing compounds of the redox couple. This would reduce the concentration of the additive compounds in uncontrolled fashion. Because the determination of the concentration of these compounds is generally very cumbersome, while the content of the compounds is very sensitive to the physical-mechanical properties of the layers, only layers having varying properties could necessarily be deposited, because a sufficiently rapidly acting and precise technique of analysis is not available.

This problem is further intensified by the fact that upon the decomposition of the additive compounds, reaction products are formed which have a detrimental effect on the properties of the layer, so that, after lengthy duration of the electrolysis, even if the content of the additive compounds is maintained by enrichment of the injurious reaction products, only unsatisfactory layers could still be deposited.

The means by which the concentration of the oxidizing compounds in the vicinity of the cathode can be minimized, preferably to a value less than about 0.015 mole/liter, are as follows:

The total amount of the compounds of the redox couple added to the plating solution is determined such that substantially the entire amount of the oxidizing compounds of the redox couple fed to the metal-ion generator with the plating solution is required for the dissolving there of the metal parts with the formation of metal ions.

The amount of metal ions provided by the dissolving must supplement the portion which is lost in the plating solution by the deposition. In order to maintain the metal-ion concentration and for the complete reduction of the amount of oxidizing compounds introduced into the metal-ion generator, a minimum size of the surface of the metal parts in the metal-ion generator is therefore required. This surface can be increased to any desired size and need not be variable. Thus, the further filling of the metal parts into the metal-ion generator can be effected in a technically simple manner in any desired amounts above said minimum amount.

The spatial distance between the anodes and the metal-ion generator must be small, and the connections for transferring the plating solution which has reached the anodes to the metal-ion generator and from the metal-ion generator back into the electrolyte space must be short. Thereby, it is achieved that the dwell time of the oxidizing compounds in the electrolyte space is short. Because of the rapid transfer of the plating solution containing the oxidizing compounds into the metal-ion generator, these compounds have only a short life until they are converted into the reduced compounds of the redox couple.

Furthermore, the velocity of flow of the plating solution must be as high as possible, particularly upon the transfer from the anodes to the metal-ion generator.

In order to keep the concentration of the oxidizing compounds as low as possible, it is also possible to introduce another oxidizing agent directly into the metal-ion generator. Atmospheric oxygen is particularly suitable for this purpose. Upon the reaction of oxygen with the metal parts, only water is produced which has no effect on the deposition process.

For introducing air into the metal-ion generator, a blower for blowing-in atmospheric oxygen is provided in the lower region of the generator.

Another possibility for supplementing the metal ions removed by deposition from the plating solution is to add the metal ions in the form of their compounds or salts to the plating solution. However, the concentration of the anionic portions of the compounds or salts necessarily added with the metal ions cannot be prevented from increasing continuously due to the continuing addition of the compound, so that, after a certain amount of time, the solution must be discarded. If only a small part of the metal ions is supplemented by addition of the corresponding compounds or salts, then the solution can last rather long. By combining the supplementing of the metal ions by addition of the salt with the regenerating of the solution in the metal-ion generator, the addition of the compounds or salts can be decreased to a few per cent of the necessary supplementation.

The possibility of controlling the metal-ion concentration in the plating solution in a simple and rapid manner from a control standpoint constitutes an advantage.

By the reduction in the lifespan of the oxidizing compounds of the redox couple which are formed on the anode, and the minimizing of the concentration of the compounds, possible decomposition of the additive compounds is avoided, or at least reduced.

The metal-ion concentration in the electrolyte space can also be controlled by a special way of circulating the plating solution. The reduced compounds of the redox couple which are converted electrochemically at the anodes by the electrolysis current back into the oxidizing compounds are present in the cathode space. The quantity of the oxidizing compounds and, thus, the metal-ion concentration can be reduced if only a part of the plating solution is conducted from the space present in the vicinity of the cathode to the anodes and from there into the metal-ion generator. The other part of this solution which does not contain the oxidizing compounds is guided directly into the metal-ion generator. For this purpose, separate outlets are provided for the plating solution, they being located in the vicinity of the cathode. The solution which is branched off over the outlets passes through suitable pipelines into the metal-ion generator.

The surface of the metal to be dissolved is dimensioned large enough that all oxidizing compounds introduced into the metal-ion generator can be converted electrochemically.

The above-described arrangement allows for a simple control of the metal-ion concentration in the plating solution and thus an automation of the control which is simple technically to achieve is made possible. The metal-ion concentration can be easily adjusted, by controlling the volumetric flows of the plating solution from the cathode via the anode into the metal-ion generator and from the cathode directly into the metal-ion generator.

Further, the velocity of flow of the plating solution in the circuit and the voltage between cathode and anode can also be adjusted to achieve an additional control.

The directions of flow of the plating solution in the electrolyte space is directed from the cathode to the anode whereby the plating solution first acts directly on the cathode. This latter is necessary to economically produce uniform layers with sufficiently high current densities and predetermined physical-mechanical properties. These flows are produced by direct flow against the cathode by utilizing nozzle assemblies or surge nozzles and by subsequent deflection of this flow towards the anodes.

The preferred apparatus includes in addition to the cathodes, insoluble, preferably perforated, dimensionally stable anodes, devices for directing the flow of the plating solution against the cathodes and anodes (nozzle assemblies, or surge nozzles), means of deflecting the flow to the anodes and connecting lines for transferring the plating solution which has been fed to the anode to the metal-ion generator as well as for transferring the plating solution emerging at the metal-ion generator back into the electrolyte space. In another preferred embodiment, means for drawing off the plating solution can also be provided in order to increase the velocity of flow upon the transfer of the plating solution from the anodes to the metal-ion generator.

In order to avoid the mixing of the parts of the plating solution which are located in the vicinity of the cathode and/or the anode, the electrolyte space can also be subdivided into several compartments by ion-pervious partition walls (ion-exchanger, diaphragms).

The metal-ion generator is preferably a tubular device which can be filled from above and which is provided with a bottom. For the entrance of the electrolyte there is at least one pipe socket with lateral openings and also, in its upper region, there is an overflow which debouches into an electrolyte container. In one particularly preferred embodiment, oblique, preferably perforated, plates are arranged within the metal-ion generator.

The process is particularly suitable for the metallizing of circuit boards. In this process, copper in particular is deposited on the surfaces of the boards and on the walls of the bore holes.

Ordinary immersion arrangements can be used in which the circuit boards are dipped from above into the plating solution, or else horizontal installations in which the circuit boards are grasped horizontally and moved by suitable means in a horizontal direction through the installation.

In addition to copper, which can preferably be deposited with the process of the invention from the arrangement which is also described, other metals, for instance, nickel, can also be deposited in accordance with the method of the invention.

The basic composition of a copper bath can vary within relatively wide limits when using the process of the invention. In general, an aqueous solution of the following composition will be used:

| | |
|---|---|
| Copper sulfate ($CuSO_4.5H_2O$) | 20–250 g/liter |
| preferably | 80–140 g/liter |
| or | |
| | 180–220 g/liter |
| Sulfuric acid, concentrated | 50–350 g/liter |
| preferably | 180–280 g/liter |
| or | |
| | 50–90 g/liter |
| Ferrous sulfate ($FeSO_4.7H_2O$) | 0.1–50 g/liter |
| preferably | 5–15 g/liter |
| Chloride ions (added, for | 0.01–0.18 g/liter |
| instance, as NaCl) | 0.03–0.10 g/liter. |
| preferably | |

Instead of copper sulfate, other copper salts can also be used, at least in part. The sulfuric acid can also be replaced, in whole or in part, by fluoboric acid, methane sulfonic acid, or other acids. The chloride ions are added as alkali chloride, for example, sodium chloride, or in the form of hydrochloric acid. The addition of sodium chloride can be dispensed with, in whole or in part, if halogen ions are already present in the additions.

The active $Fe^{2+}/Fe^{3+}$ redox couple is formed from ferrous sulfate heptahydrate. It is excellently suited for the regenerating of the copper ions in aqueous acid copper baths. However, other water-soluble iron salts can also be used, in particular ferric sulfate nonahydrate, provided that the salts do not contain biologically non-degradable (hard) complex formers in the compound, since the latter result in problems in connection with the disposal of the flushing water (for example, iron-ammonium alum).

In addition to iron salts, compounds of the elements titanium, cerium, vanadium, manganese, chromium and the like are also suitable as further redox couples. Compounds which can be used are, in particular, titanyl sulfuric acid, ceric sulfate, sodium metavanadate, manganous sulfate, and sodium chromate. For special uses, combinations of the above redox couples can also be used.

With the process of the invention, the other elements which are known and have been tested in electrolytic metal deposition can be retained. Thus, ordinary brightening agents, leveling agents and surface-active agents can, for instance, be added to the plating solution. In order to obtain copper precipitates having predetermined physical-mechanical properties, at least one water-soluble sulfur compound and an oxygen-containing high-molecular compound are added. Additive compounds such as nitrogen-containing sulfur compounds, polymeric nitrogen compounds, and/or polymeric phenazonium compounds can also be used.

The additive compounds are contained in the plating solution within the following concentration ranges:

| | |
|---|---|
| ordinary oxygen-containing | 0.005–20 g/liter |
| high-molecular compounds | 0.01–5 g/liter |
| preferably | |
| ordinary walter-soluble | 0.005–0.4 g/liter |
| organic sulfur compounds | 0.001–0.15 g/liter |
| preferably | |

Thiourea derivatives and/or polymeric phenazonium compounds and/or polymeric nitrogen compounds as addition compounds are used in the following concentrations:

| | |
|---|---|
| | 0.0001–0.50 g/liter |
| preferably | 0.005–0.04 g/liter |

For the preparation of the plating solution, the additive compounds are added to the above-indicated basic composition. The conditions for the deposition of copper are indicated below:

| | |
|---|---|
| pH | <1 |
| Temperature: | 15° C.–50° C. |
| preferably | 25° C.–40° C. |
| cathodic current density: | 0.05–12 amp/dm$^2$ |
| preferably | 3–7 amp/dm$^2$ |

A few oxygen-containing high-molecular compounds are listed in the following Table 1:

TABLE 1

| (Oxygen-Containing, High-Molecular Compounds) |
|---|
| Carboxymethyl cellulose |
| Nonylphenol-polyglycolether |
| Octanediol-bis-(polyalkylene glycol ether) |
| Octanolpolyalkylene glycol ether |
| Oleic acid-polyglycol ester |
| Polyethylene-propylene glycol + polyethylene glycol |
| Polyethylene glycol-dimethylether |
| Polyoxypropylene glycol |
| Polypropylene glycol |
| Polyvinyl alcohol |
| Stearic acid polyglycol ester |
| Stearyl alcohol polyglycol ether |
| β-Naphthol polyglycol ether |

TABLE 2

| (Sulfur Compounds) |
|---|
| 3-benzthiazolyl-2-thio)-propylsulfonic acid, sodium salt |
| 3-mercaptopropane-1-sulfonic acid, sodium salt |
| Ethylenedithiodipropyl sulfonic acid, sodium salt |
| Bis-(p-sulfophenyl)-disulfide, disodium salt |
| Bis-(ω-sulfobutyl)-disulfide, disodium salt |
| Bis-(ω-sulfohydroxypropyl)-disulfide, disodium salt |
| Bis-(ω-sulfopropyl)-disulfide, disodium salt |
| Bis-(ω-sulfopropyl)-sulfide, disodium salt |
| Methyl-(ω-sulfopropyl)-disulfide, disodium salt |
| Methyl-(ω-sulfopropyl)-trisulfide, disodium salt |
| O-ethyl-dithiocarbonic acid-S-(ω-sulfopropyl)-ester, potassium salt |
| Thioglycolic acid |
| Thiophosphoric acid-O-ethyl-bis-(ω-sulfopropyl)-ester, disodium salt |
| Thiophosphoric acid-tris-(ωsulfopropyl)-ester, trisodium salt |

A few sulfur compounds having functional groups suitable for the production of water solubility, are set forth in the above Table 2.

By blowing air into the electrolyte space, the plating solution is moved. By an additional flow of air to the anode and/or the cathode, the convection on their surface areas is increased. This causes an optimization of the material transport around the cathode and/or anode resulting in higher current densities. Corrosive oxidizing agents which are possibly produced in a small amount, such as for example oxygen and chlorine, are thereby led away from the anodes. Movement of the anodes and cathodes also results in an improved material transport on the corresponding surfaces, causing a constant diffusion-controlled deposition. The movements can take place horizontally, vertically, in uniformly lateral movement, and/or by vibration. A combination of air flow is particularly effective.

Inert material is used for the anodes. Suitable anode materials which are chemically and electrochemically stable to the plating solution and the redox couple are for example, titanium or tantalum as base material, coated with platinum, iridium, ruthenium, or their oxides or mixed oxides. Titanium anodes having an iridium-oxide surface treated with spherical bodies and thereby compacted to be free of pores, were sufficiently resistant, and therefore had a long lifespan. The quantity of the corrosive reactions produced on the anode is determined by the anodic current density or the anode potentials adjusted via the voltage between cathode and anode. Below 2 amp/dm$^2$ the rate of formation of such corrosive reactions is very small. Thus, in order not to exceed this value, large effective anode surfaces are desirable. Therefore, if space is limited, perforated anodes are preferred, for example, anode nets or expanded metal having a suitable coating are used. This way, the advantage of a large effective surface is combined with the simultaneous possibility of intensive flow through the anode by the plating solution, so that any corrosive reaction produced can be led away. Anode nets and/or expanded metal can, in addition, be used in several layers. The effective surface is thereby correspondingly increased, so that the anodic current density with a predetermined electroplating current is reduced.

Metal is supplemented in a separate container, metal-ion generator, through which the plating solution passes. In the case of copper deposition, metallic copper parts, for example, in the form of pieces, balls or pellets, are present in the metal-ion generator. The metallic copper used for the regeneration need not contain phosphorus, but phosphorus is not disturbing if present. Upon the additional use of soluble copper anodes, the composition of the anode material, on the other band, is of great importance. In that case, the copper anodes must contain about 0.05% phosphorus. Such materials are expensive, and the addition of phosphorus causes residues in the electrolytic cell which must be removed by additional filtration.

In accordance with the method of the invention, it is also possible to use metallic copper parts which contain no additives and thus, electrolytic copper, including copper scrap, is generally used. An interesting variant is that the circuit board waste which is coated with copper, such as obtained in large quantities upon the production of printed circuit boards, can also be used for this, provided that it does not contain further metals. This waste, consisting of the polymeric base material and the copper layers applied thereto, can be disposed of in traditional manner only at high expense due to the firm bond between the two materials. After the profitable dissolving of the copper of this waste in a metal-ion generator suitable for this, a sorted disposal of the base material is possible. In similar fashion, reject circuit boards can also be used.

Furthermore, filters for the removal of mechanical and/or chemical residues can also be inserted in the circulation of the plating solution. However, the need for them is less than with electrolytic cells having soluble anodes, since the anode sludge produced by the mixture of phosphorus to the anodes is not present.

DESCRIPTION OF THE PREFERRED EMBODIMENTS

Figure 1:
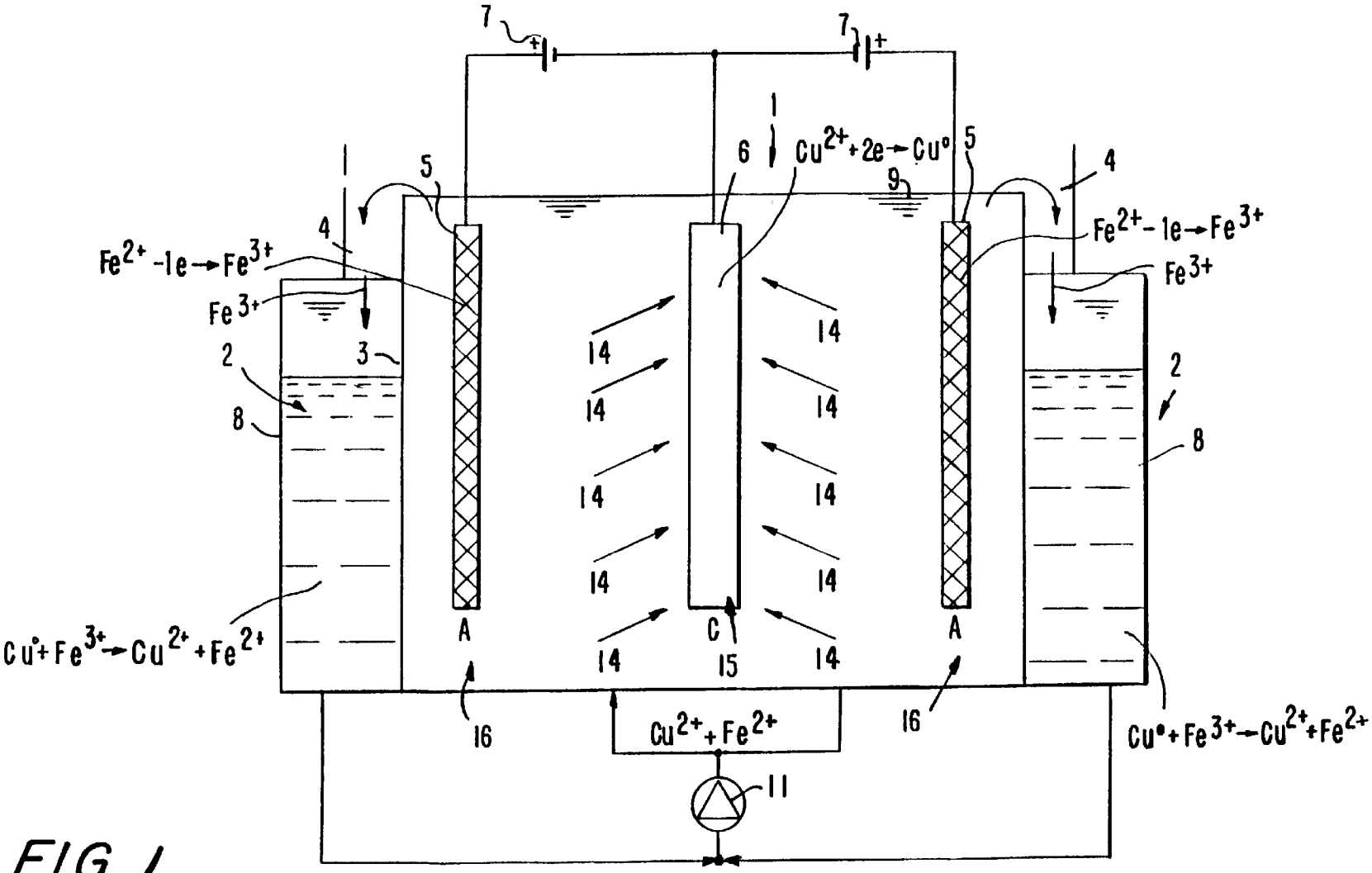
FIG. 1 diagrammatically shows an apparatus for the immersion treatment.

FIG. 1, shows an apparatus for immersion treatment according to the invention. The electrolyte space 1 is located in the container 3. The metal-ion generator 2 is so constructed and arranged with respect to the container 3 as to result in short paths for the feeding of the plating solution from the anodes 5 to the metal-ion generator and from there back again into the electrolyte space. For this reason, the metal-ion generator is divided into two parts arranged in the vicinity of the insoluble anodes. This division in two is, however, not necessary. Thus, for example, it can also be arranged as a single unit to the side of or below the bath container. The copper parts to be dissolved are introduced in a loose pile into the metal-ion generator in order to permit easy passage of the plating solution through the generator. On the other hand, however, a minimum loading with copper parts must be maintained therein. The pump 11 pumps tie plating solution in a closed circuit through the arrangement. It is essential that the material 6 being treated, which is connected as cathode, be acted upon by the plating solution which is enriched in copper ions, as indicated by the arrows 14, via nozzle assemblies or surge nozzles, not shown here. This causes the copper layers to be deposited on the surface of the material 6 with the necessary quality and the necessary speed. In addition, a further flow takes place within the electrolyte space from the space 15 present in the vicinity of the material being treated in the direction towards the space 16 present in the vicinity of the anodes. The plating solution which has been brought to the anodes passes through the spaces and through the anode, in the case of perforated anode, and arrives, with the advance of the flow, into the outlet 4 which leads to the metal-ion generator. This flow minimizes a transport of anodically formed oxidizing compounds of the redox couple (ferric ions) into the cathode space 15. This, in turn, prevents the injurious decomposition of the addition compounds, with simultaneous increase of the cathodic current efficiency.

Along the transport path from the anodes via the outlet into the metal-ion generator, the additive compounds are probably decomposed via a chemical decomposition reaction with the participation of the oxidizing compounds of the redox couple. Therefore, the shortest possible connection with high velocity of the plating solution to the metal-ion generator is desirable outside the electrolyte space 1.

The minimum loading of the metal-ion generator with copper parts provides assurance that the oxidizing compounds formed are completely converted within the metal-ion generator and the concentration of these compounds at the outlet of the metal-ion generator is lowered to a value of about zero. This means that the copper surface which is in contact with the plating solution in the metal-ion generator leads to the complete reduction of the oxidizing compound to the reduced compounds (ferrous ions), with simultaneous electroless dissolving of copper with the formation of copper ions. The reduced compounds of the redox couple do not contribute to the decomposition of the addition compounds.

By targeted flow onto the cathode surfaces, the anodes, for a given total circulation, are subjected to less electrolyte exchange. In this way, the corrosive gases possibly produced at the anodes are led away correspondingly slower, so that, on the one hand, the corrosion of the anodes increases while, on the other hand, it is limited by the following measures:

low anodic current density inert base material of the anodes inert coating of the anodes surface compacting of the anodes liquid-pervious anode geometry.

By these measures, the result is obtained that the additive compounds which are added to the plating solution in order to control the physical-chemical properties of the layer of metal can be used also in arrangements with insoluble, dimensionally-stable anodes. Special mixtures of the addition compounds are not necessary for this. A high cathodic current efficiency and a long life of the insoluble anodes is obtained.

Figure 2:
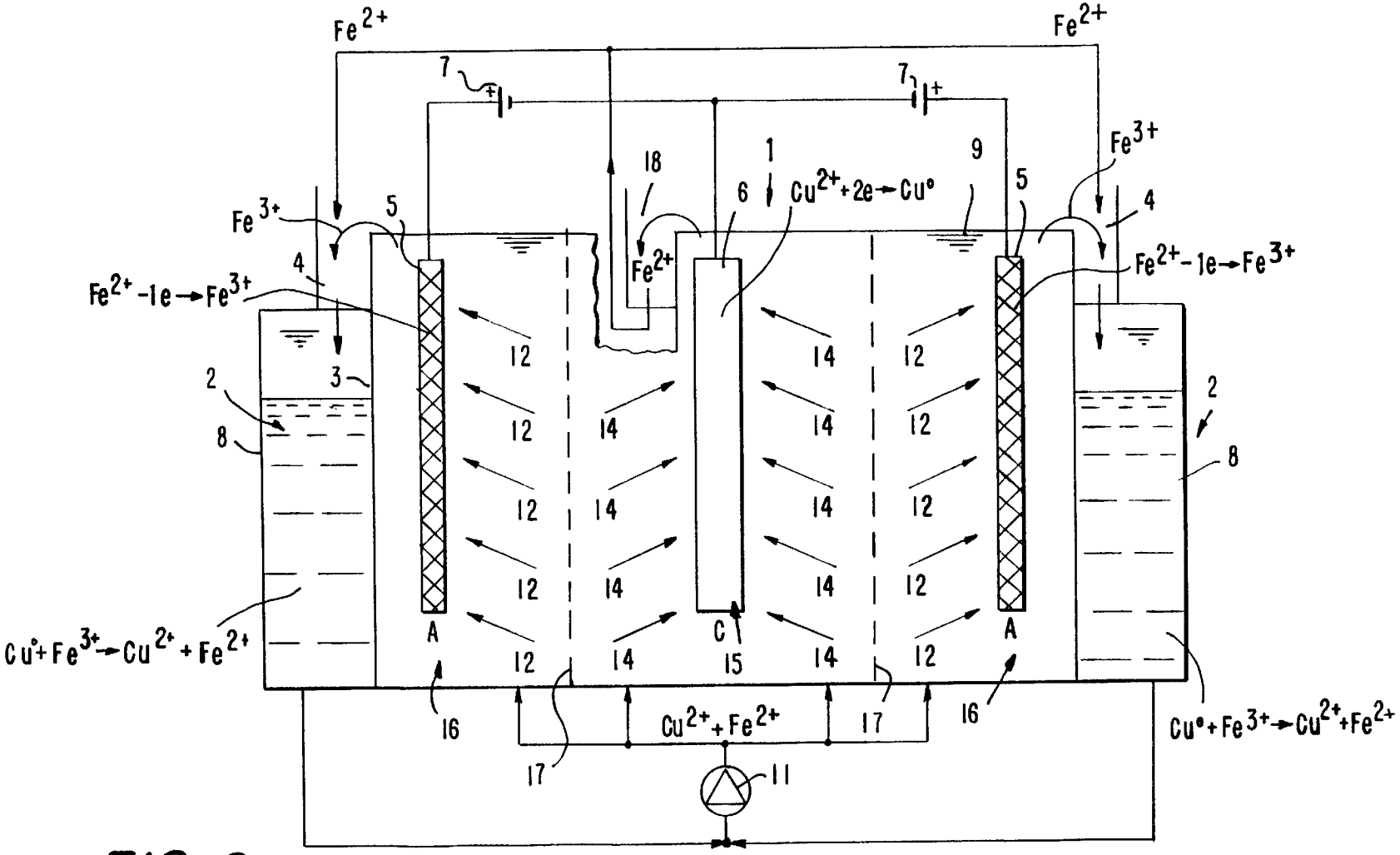
FIG. 2 shows the principle of an apparatus without and with diaphragm.

FIG. 2 shows another apparatus in accordance with the invention. It differs from the arrangement shown in FIG. 1 by the guidance of the plating solution within the electrolyte space, which consists of a space 15 present in the vicinity of the material being treated, namely the cathode space, and of the spaces 16 present in the vicinity of the anodes, namely the anode spaces. These spaces are separated by the dashed separation lines 17 in the drawing. The plating solution, which was enriched with copper ion in the metal-ion generator 2 upon the reduction of ferric to ferrous ions, flows separately into each space and passes through nozzle assemblies or surge nozzles (not shown) as shown by the arrows 12 and 14 to the anodes 5 and the cathodic treatment material 6. Mixing of the plating solution in the anode space 16 with the solution in the cathode space 15 can take place only to a slight extent, in particular for the reason that the plating solution has its own outlets 4 from the anode space and, separately therefrom, the plating solution has an outlet 18 in the cathode space. In this embodiment, the ferric ion concentration is kept small in the cathode space, which is connected directly with the inlet to the metal-ion generator 2, so that a short conduction path from the anode space to the metal-ion generator results. On the other hand, the transport paths from the cathode space via the outlet 18 to the generators can be long, since there are no injurious interactions between the reduced compound which is contained in the plating solution present in the cathode space and the addition compounds. In order to avoid even a slight electrolyte mixing of the plating solutions in the cathode and anode spaces, these spaces can be separated along the lines 17 by, in each case, an ion-pervious partition wall (diaphragm) which, in its turn, is not chemically changed by the plating solution. The partition walls are pervious for the plating solution only to a very slight extent, if at all, so that they permit possibly only a slow equalization of different hydrostatic pressures in the spaces 15 and 16. Polypropylene fabrics or other membranes with a permeability for metal ions and their corresponding gegenions (for instance the Nafion of DuPont de Nemours, Inc., Wilmington, Del., USA) are, for example, suitable. By separation of the spaces by partition walls, assurance is had that the plating solution cannot pass, for instance, by eddying from the anode space into the cathode space. This measure leads also to a further decrease in the concentration of the oxidizing compounds of the redox couple in the vicinity of the cathode. Therefore, advantageous effects with respect to the resistance to aging of the plating solution result also from these measures.

The plating solution which is present in the anode space and which contains the ferric ions formed there is, in its turn, transferred, over the shortest path, into the metal-ion generator and enriched there again with copper, with the formation of ferrous ions. In practical operation, a condition of equilibrium between the copper solution in the metal-ion generator and the deposition of copper on the material being treated is established.

Figure 3:
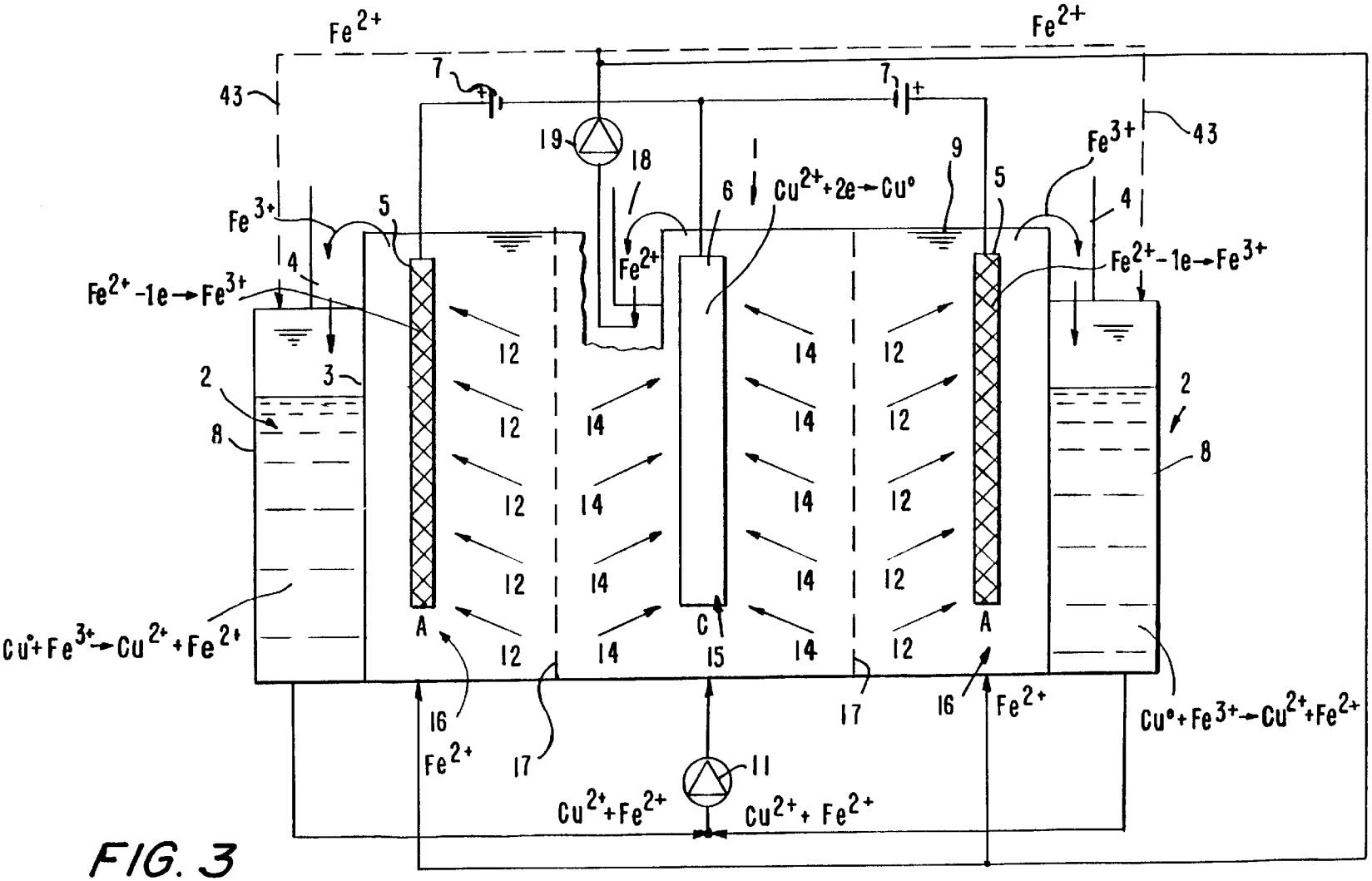
FIG. 3 shows the principle of an apparatus with serial conducting of the plating solution.

FIG. 3 shows another embodiment of the invention, having a two-part metal-ion generator. The plating solution which is enriched in copper ions in the metal-ion generator 2, is introduced only into the cathode space 15. This solution contains, furthermore, only ferrous ions and no ferric ions. The plating solution is conducted in succession from the cathode space 15 to the anode space 16. The ferrous ions formed in the metal-ion generator therefore, after passing through the cathode space, enter with the plating solution via a pump 19 into the anode space. The feeding of the plating solution into the cathode space is effected by another pump 11. A hydrodynamic constancy and the constant transport conditions resulting therefrom are advantageous for the electrochemically active additions of the redox couple.

Furthermore, this serial conducting of the plating solution permits a dividing up of the plating solution withdrawn from the cathode space. In order to control the concentration of the copper ions in the electrolyte space 1, comprising the cathode and anode spaces, a part of the solution is conducted via the lines 43 indicated in dashed line, directly into the metal-ion generator. This partial quantity contains practically no oxidizing compounds of the redox couple, so that the copper dissolving rate is reduced by admixture of this portion into the stream of solution which is introduced from the anode space into the metal-ion generator. By control and/or regulation of the partial quantities of the two streams by means of three-way valves (not shown), the copper ion concentration in the plating solution can be adjusted. In the arrangement shown in FIG. 2, these possibilities are not used, although, in that case also, two separate outlets 4 and 18 are present for the plating solutions from the cathode and anode spaces. The solutions of the two spaces are brought together there and conducted jointly into the metal-ion generators. The regenerated solutions coming from the metal-ion generators are fed to the spaces 15 and 16. The manner of procedure in accordance with FIG. 3 is advantageous when the plating solutions of the anode and cathode spaces cannot be mixed together in the electrolyte space, but a complete separation of the discharging solutions is not assured in the outlets 4 and 18 from the anode and cathode spaces.

In FIGS. 1 to 3, the introduction of the plating solution enriched in copper ions into the container 3 is shown, by way of example, to by effected from below and the introduction into the metal-ion generator from above. In a corresponding manner, the off lines from outlets 4 and 18 from the container 3 are shown at the top and those from the metal-ion generator 2 at the bottom. Circulation of the plating solution in other directions is also possible, such as, for instance, the introduction of the solution into the metal-ion generator from below.

Figure 4:
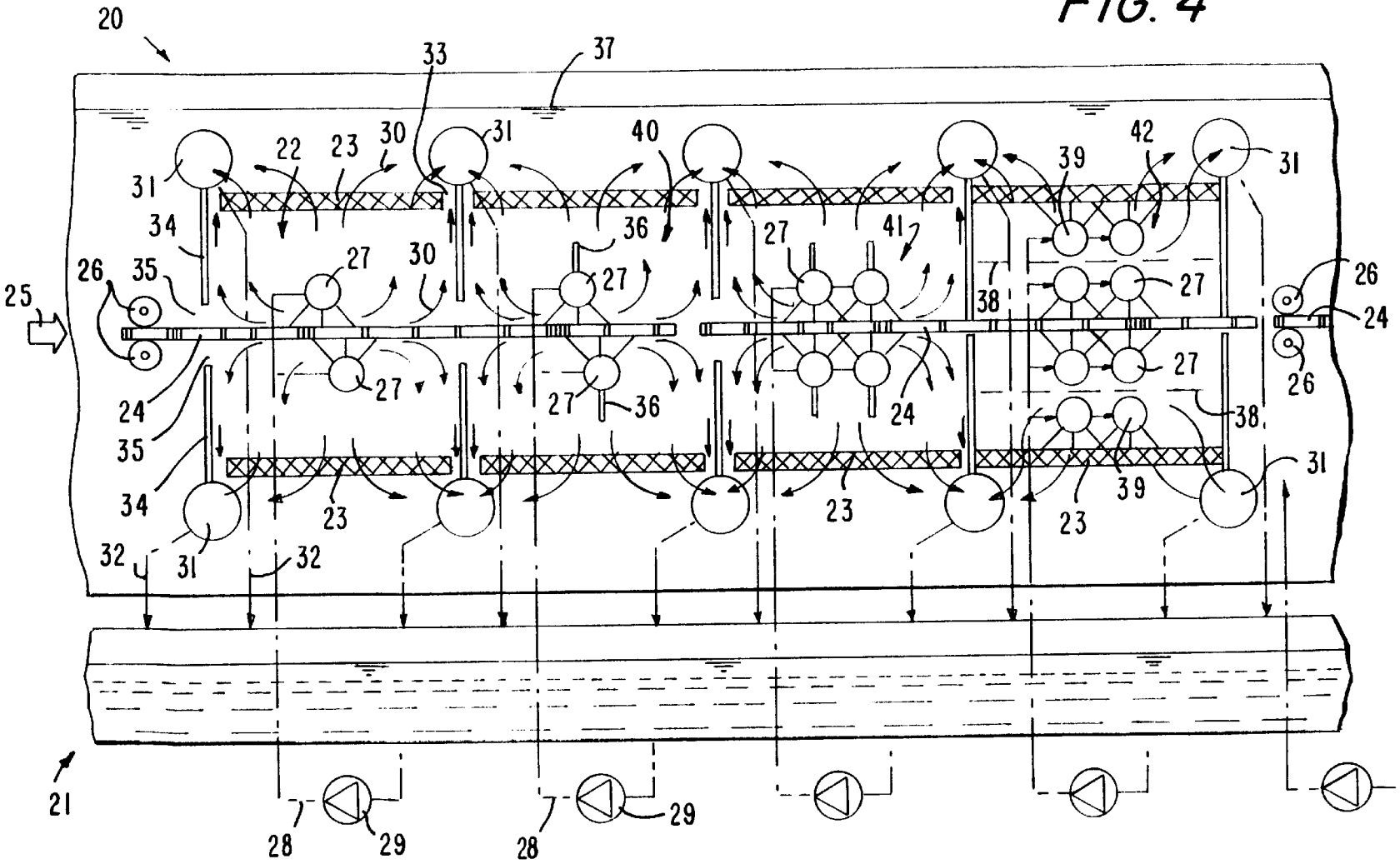
FIG. 4 shows the principle of an apparatus for the horizontal transport of the material being treated.

Another embodiment of the invention, particularly for the electrolytic metallizing of plate-shaped treatment material, preferably circuit boards, in horizontal passage through the arrangement, is shown in FIG. 4. The system, part of which is shown in side view, consists of the electrolytic part 20 and a metal-ion generator 21 filled with copper, shown below it. The electrolytic part 20 consists of a plurality of individual electrolytic cells. Four of these individual cells are designated by the reference numerals 22, 40, 41, 42 in FIG. 4, with an insoluble anode 23 in each case for the top side and the bottom side of the treatment material 24. The treatment material is electrically connected to a rectifier (not shown) and is cathodically polarized. It is transported through the installation, in the direction of the arrow 25, by means of rollers or disks 26. The transport elements 26 are uniformly distributed along the entire installation. For reasons of simplification of the drawing, they have been shown here only at the beginning and end of the transport path. Surge nozzles or flood pipes 27, 39 are also present, uniformly distributed in the electrolytic cells. They correspond to the nozzle assemblies already mentioned above.

Plating solution coming from the metal-ion generator 21 is fed by pumps 29 to the flood pipes 27, 39 via the pipelines 28. The plating solution flows through the outlet openings of the flood pipes or surge nozzles onto the surfaces of the treatment material 24. Copper ions are reduced to metallic copper and deposited as a metallic layer on the material to be treated, and the ferrous ions, also present, are conveyed with the discharging electrolyte in the direction towards the anodes 23. In order to avoid a return flow from the anodes to the cathodes, various methods are provided, the effecting of which is shown diagrammatically in FIG. 4. The plating solution which is enriched with copper is used for flow to the cathode (treatment material). From the board-shaped treatment material, the stream of solution is then so deflected that, as indicated by arrows 30, it continues in the direction towards the anodes. In the case of perforated anodes, which are preferably used, the solution passes through them and then passes via suction pipes 31 and pipelines 32 back into the metal-ion generator. The anodes can consist, for instance, of expanded metal or netting. Openings 33 support the flow process. In order to avoid the formation of eddying, baffle walls 34 extending in the direction towards the material being treated can be arranged on the suction pipes. The slot 35 remaining between the baffle walls and the treatment material can amount to a few millimeters. From the standpoint of fluid mechanics, this forms practically closed electrolytic cells having favorable flow conditions. The flood pipes 27 can also be provided with baffle walls 36 in order to prevent further possible eddies.

Different flood pipes in different number are shown, by way of example, in the electrolytic cells of the arrangement shown in FIG. 4. The circulation of the plating solution is such that the level 37, which is above the suction pipes, is present in the electrolytic part of the installation. In the electrolytic cell 42 shown on the right, partition walls 38 are shown between each of the anodes 23 and the treatment material 24. In this way, the exchange of the plating solutions in the cathode and anode spaces over a direct path is minimized. By the use of ion-pervious partition walls, on the other hand, an ion-exchange between the chambers is made possible. The solution in the cathode space can emerge at the end side. In the anode space further flood pipes 39 are provided. The solution of this chamber passes out via the suction pipes 31. For such a cell, the serial flow path such as already described on the basis of FIG. 3 is again suitable.

The leading away of the plating solution from the anode space via the suction pipes 31 into the metal-ion generator 21 can take place over the shortest path in order to keep the life of the ferric ions as short as possible. Therefore, the metal-ion generator 21 is arranged here also as close as possible to the electrolytic part 20. In this way, short connection paths and short transport times result. The principle of construction can advantageously also be so selected that the parts 20 and 21 form a complete system. Each of several flood pipes 27 is fed by a pump 29 in the manner shown in FIG. 4. However, a single pump can also be used. This would lead to longer connecting paths between the flood pipes 27, 39 and the metal-ion generator 21. The plating solution in these connecting lines contains practically no oxidizing compounds of the redox couple. Thus, the protection of the addition compounds is assured in this region also.

The electroplating installation in shown in side view in FIG. 4. The parts shown (anodes, pipes) extend in length into the depth of the drawing, and therefore transverse to the direction of transport over the material to be treated. The parts present in the electrical field between anode and cathode, such as, for example, the flood pipes 27, consist of electrically non-conductive plastic. Their electric screening action is not disturbing here, since the material to be treated moves slowly through the installation and thus is continuously exposed to the different electrical fields.

Figure 5:
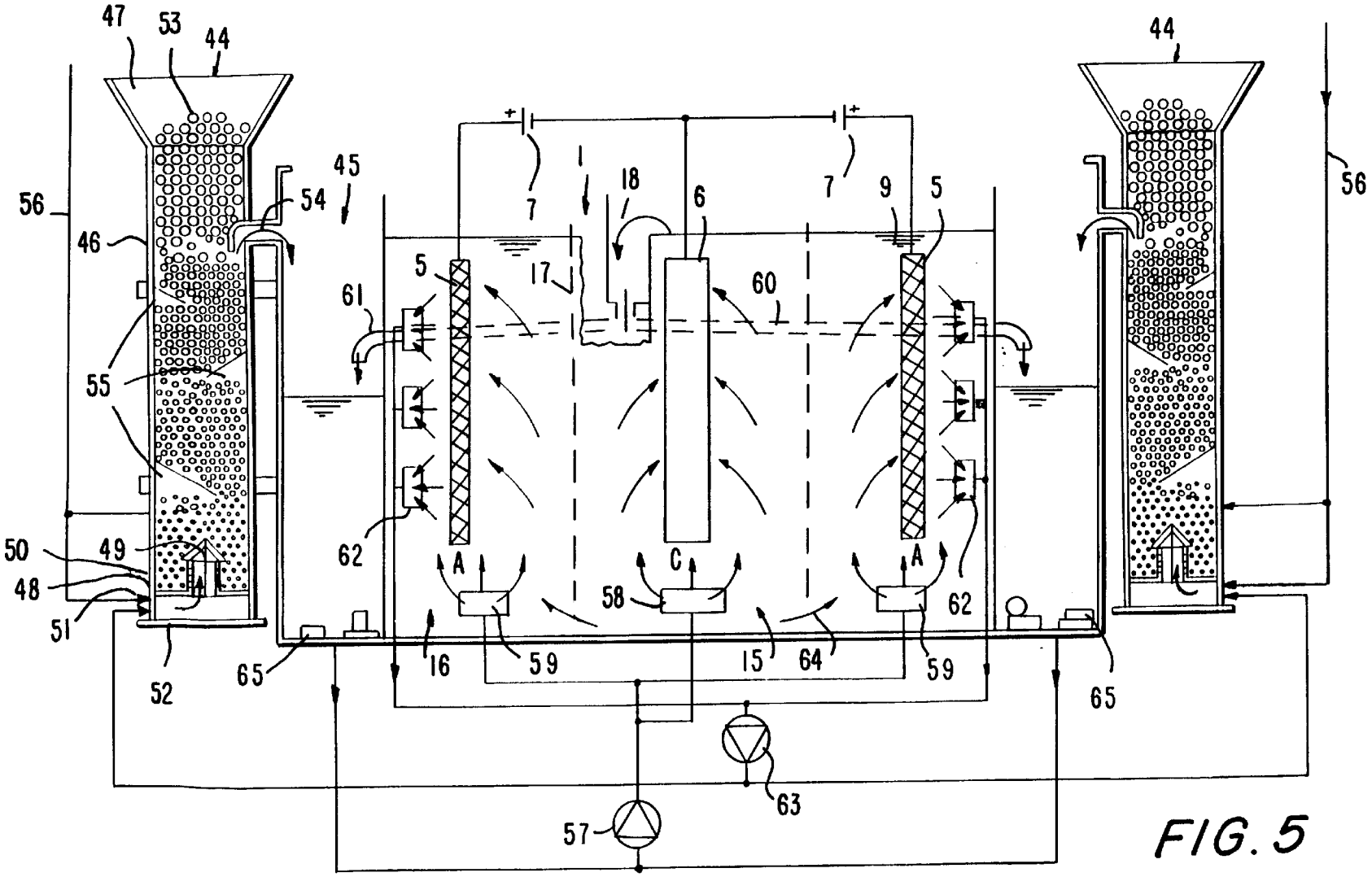
FIG. 5 shows a metal-ion generator on an apparatus for immersion treatment.

FIG. 5 shows an arrangement in accordance with the invention having two metal-ion generators 44, an electrolyte space 1, and two additional electrolyte containers 45. This arrangement is operated in the dip process. In this case, the cell is developed symmetrically for the electroplating of the front and rear sides of the treatment material 6. The two metal-ion generators 44 shown in the figure and the electrolyte containers 45 can in each case also be provided individually and in such case arranged on both sides of the material being treated.

The metal-ion generator 44 consists of a preferably round tubular body 46 having an upper opening 47. All materials used for this are resistant to the plating solution and the additions contained in the solution. At least one pipe socket 49 extends through the bottom 48 of the metal-ion generator into the inside of the metal-ion generator. This pipe socket has lateral openings 50. They form a screen which, on the one hand, prevents penetration of metallic copper into the pipeline system and, on the other hand, permits the passage of the plating solution into the metal-ion generator. A small roof on top closes the top of the pipe socket. The roof at the same time holds the lateral openings 50 free of fine copper granulate which is present in this region of the metal-ion generator. Below the bottom, there is a mixing and collection chamber 51. Copper particles and impurities which were able to pass through the screen are collected in it. After opening the base plate 52, the chamber is accessible for cleaning purposes. Upon operation, the plating solution pumped out of the anode space 16, which solution is enriched in copper-dissolving ferric ions, enters. In addition, air which contains oxidizing oxygen can also be blown into the metal-ion generator via lines 56. In this case, the chamber 51 serves at the same time as mixing chamber. Through the holes 50 in the pipe socket 49, the plating solution and possibly air enter into the inside of the metal-ion generator. In the lower region of the generator there is predominantly fine copper granulate which has been formed by the dissolving of the metallic copper. It has a very large specific surface, which offers itself immediately for the dissolving of copper to the incoming plating solution which is enriched in ferric ions. The ferric ions are therefore rapidly reduced to ferrous ions, with the simultaneous dissolving of copper. Within the metal-ion generator, the quantity of ferric ions decreases rapidly towards the top. This has the result that the electrolytic copper which has been introduced as granulate or sections 53 is dissolved in upward direction to a continuously lesser extent. The dimensions of the granulate remain large in the upper region of the metal-ion generator. Thus, the permeability for the plating solution is also retained. Through the overflow 54, the solution discharges without pressure from the metal-ion generator into the electrolyte container 45. Within the metal-ion generator, the overflow 54 bends downward in such a manner that copper granulate 53 which slides downward from above cannot lead to the clogging of the generator. As a result of the sufficiently large dwell times, adapted to each other, of the plating solution which has entered into the generator, and which, at the same time, is sufficiently long for the dissolving of the copper surface offered, the plating solution which flows over the overflow 54 into the electrolyte container 45 contains practically no ferric ions any longer. Such an over-dimensioning of the regeneration unit thus provides assurance that the attack of the ferric ions on the addition compounds of the plating solution is complete already in the middle region of the generator.

The filling and refilling of the metal-ion generator with metallic copper 53 is effected from above, through the opening 47 of, for instance, hopper shape. It can be closed by a cover. The region above the overflow 54, in which no plating solution is present, serves for the storing of metallic copper which is to be dissolved in the metal-ion generator. The filling and refilling can be effected manually. The arrangement is excellently suited for the automating of the filling process due to the absence of pressure at the filling opening 47 and the vertical or oblique arrangement. The filling can take place continuously or batchwise. Transport belts or vibratory conveyors (not shown here) which are known from the conveyance art transport the metallic copper into the openings 47 of the generators.

The invention has the advantage that copper parts of different geometrical shape can be dissolved in the metal-ion generator. Different shapes, however, have a different piling behavior. In order to maintain the permeability of the pile for the plating solution and to assure a sufficiently large copper surface which is accessible to the solution, additional individual measures are possible: Downwardly inclined plates 55 within the generator prevent too great a compacting of the copper in the lower region. The plates are provided with holes the dimensions of which are adapted to the size of the metallic copper parts introduced. The holes are selected from plate to plate smaller from top to bottom corresponding to the dissolving of the copper. Similarly, the dimensions of the plates can increase from the top to the bottom. The angle of inclination can also be adapted to the circumstances of the pieces of copper introduced into the metal-ion generator.

The inclined position of the metal-ion generator itself can have the same result. By the blowing of air 56 into the lower region of the metal-ion generator or into the mixing and collecting chamber 51, a copper-dissolving substance, in this case oxygen, can also be introduced. In addition to this, the eddying of the copper granulate in the metal-ion generator connected therewith increases the reduction of the ferric ions and the dissolving of the copper. At the same time, the permeability for the plating solution through the copper parts is increased. With copper fillings which hook on to each other, it may be advisable to shake the metal-ion generator at times or continuously. The shaking movement can preferably be obtained from a vibrating conveyor, with which the automatic filling can at the same time be effected. All the measures described above for disturbance-free continuous operation of the metal-ion generator can also be combined with each other.

Figure 6:
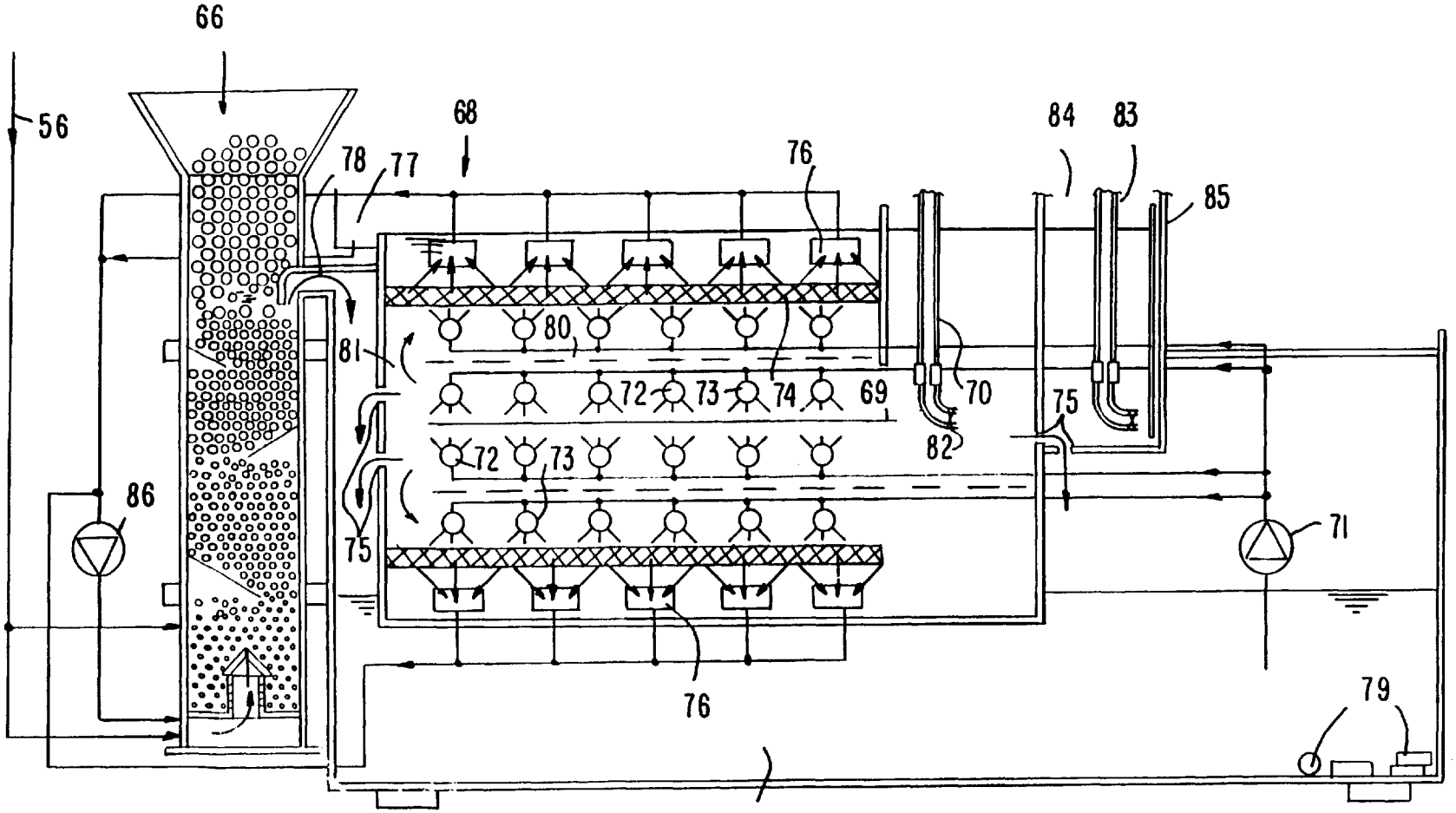
FIG. 6 shows a metal-ion generator on an apparatus for the horizontal transport of the material being treated.

The electrolyte containers 45, 67 shown in FIGS. 5 and 6 serve to reduce the dependence of the flow of the plating solution along the treatment material 6, 69 on the flow through the metal-ion generator 44, 66. This has the advantage that, in both circuits, the quantity of plating solution and its speed can be adjusted individually. These processes are described below with reference to FIG. 5.

The plating solution is conveyed by a pump 57 from the electrolyte container 45 into the electrolyte space 1. The solution flows through the flood pipes 58 arranged there onto the treatment material 6 and from the flow pipes 59 onto the liquid-pervious insoluble anodes 5. The division of the stream of solution over the flow pipes 58 and 59 is effected by adjustable valves, not shown in the drawing. From the cathode space 15, the plating solution flows via the outlet 8 through pipelines 60 and the outlet 61 back into the electrolyte container 45. Closely behind the anodes 5 there are suction pipes 62 through which the plating solution enriched with ferric ions is drawn off by means of the pump 63 and conveyed with high speed into the metal-ion generator. From there, the solution enriched with ferrous and cupric ions then returns again into the electrolyte container 45.

The division of the streams over the flood pipes 58 and 59 is so adjusted that an excess results in the cathode space 15. This equalizes itself with the anode space 16. If the two spaces are separated by a partition wall 17, as shown in FIG. 5, then at least one opening 64 in the partition wall sees to it that the equalizing of the plating solutions in the two spaces can take place in the direction indicated by the arrow. In order to avoid a mixing of the solutions in the electrolyte space 1 and a convective transport of ferric ions from the anode space to the cathode space, it therefore need merely be seen to it that a higher hydrostatic pressure is present in the plating solution in the cathode space 15 than in the anode space 16. This is assured by a corresponding adjustment of the partial streams through the flood pipe 58 and the flood pipes 59 of the circuit of the pump 57. In addition, the circuits of the pumps 57 and 63 are independent of each other.

Within the metal-ion generator, all ferric ions introduced with the feed stream are reduced to ferrous ions. Nevertheless, it cannot be excluded that a very small, scarcely measurable number of ferric ions pass through the metal-ion generator and enter into the electrolyte container 45. In order to reduce the ferric ions which have entered into said container to ferrous ions, copper parts 65 are introduced also into this container. In this case, copper scrap may also be used.

Another embodiment of the apparatus in accordance with the invention for the carrying out of the process is shown in FIG. 6. This Fig. shows a horizontal circuit board electroplating installation shown in cross section. The figure shows the metal-ion generator 66, an electrolyte container and an electroplating cell 68. The circuit board 69 which is to be metallized is gripped in the arrangement by clamps 70 and conveyed horizontally through the installation. The contacting of the circuit board with the negative pole of a rectifier (not shown) is also effected via these clamps. In another embodiment, the contacting could also be effected by contact wheels. A pump 71 pumps the plating solution via flood pipes 72, 73 to the circuit boards and to the insoluble perforated anodes 74. Via outlets 75, the plating solution is conducted out of the cathode space back into the electrolyte container 67. From the anode space, the pump 86 conducts the plating solution which has been enriched with ferric ions through suction pipes 76 at high speed into the metal-ion generator. An outlet 77, which is developed as overflow for regulating the level, sees to it that excess plating solution passes from the upper region of the anode space also into circuit to the metal-ion generator 66 and not into the electrolyte container 67. The metal-ion generator is constructed in the manner which was described with reference to FIG. 5. Via the overflow 78, the plating solution passes back into the electrolyte container 67. In the latter, there are also contained copper parts 79 which effect a reduction to ferrous ions of stray ferric ions which are possibly present in this region. Furthermore, partition walls 80 are provided between the anode and cathode spaces. Openings 81 in these partition walls see, here also, to an equalization of the streams of the plating solution from the cathode space into the anode space. These directions of flow are also established if no partition walls are present.

Horizontally operating continuous installations such as shown in FIGS. 4 and 6, and vertically operating electroplating installations have dimensions of several meters in length of the electrolytic cells. Therefore, in practice, preferably several metal-ion generators are arranged along the installation. This makes it possible to set them up in close spatial vicinity to the electrolytic cell or effect a partial or complete placing of electrolytic cell, electrolyte container, and metal-ion generator one within the other.

During the passage of a circuit board through the electroplating installation, the clamps 70 are also metallized in the region of their contacts 82. This layer must be removed again before the clamps are again used. This is done, in known manner, during the return of the clamps to the start of the electroplating installation. In this connection, the returning clamps 83 pass through a separate compartment 84 which is connected with the plating solution in the electrolytic cell 68. For the demetallization, the clamps 83 are connected via wiper contacts with the positive pole of a rectifier, not shown. The negative pole of this rectifier is connected to a cathode plate 85. During the electrolytic demetallization process, copper deposits on the insulating layers of the clamps 83 lose electric contact with the current supply before they are completely dissolved. Therefore, undesirable deposits of copper on these regions remain behind. Thus, in accordance with the invention, the parameters for the demetallization, namely current and time, are adjusted so that, for example, only 70% of the demetallization path is required for the removal of the metal layer. In the remaining path, $Fe^{3+}$ions are produced by the electrolysis current on the metallic contacted parts of the clamps. These ions are present precisely at the place where contact-less copper deposits are possibly still present. They dissolve this copper electrolessly. No noticeable increase in ferric ions in the electrolytic cell occurs as a result of his because, as compared with the metallizing of tile treatment material, only very small currents and surfaces are involved.

In order to maintain an operable deposition of metal, the copper content in the plating solution must be kept within given limits. This presupposes that the consumption rate and the rate of addition of copper ions correspond. In order to check the copper content, the absorption power of the plating solution can be measured at a wavelength of for instance 700 nm. The use of an ion-sensitive electrode has also proven suitable. The measured value obtained serves as actual value of a controller the control value of which is used to maintain the copper-ion concentration in the specific embodiments of the invention described.

For the analytical control of the concentrations of the compounds of the redox couple, a potential measurement can be carried out. For this purpose, a measurement cell is used which is formed of a platinum electrode and a reference electrode. By suitable calibration of the measured potential with the concentration ratio of the oxidizing and reduced compounds of the redox couple for a given total concentration of the compounds, the corresponding concentration ratio can be determined. The measurement electrodes can be installed both in the anode and cathode spaces as well as in the pipelines of the arrangement.

In order to control the anode processes, such as, for example, the oxidation of the redox couple required for the production of copper and a possible anodic decomposition of the addition compounds, a further measuring device can be provided with which the cathode potential is measured with respect to a reference electrode. For this purpose, the anode is connected via a potential measuring instrument with the corresponding reference electrode.

The continuous or discontinuous measurement of further galvanotechnical parameters is advisable, such as, for instance the determination of the content of addition compounds by means of cyclic voltametrics. Thus, after lengthy pauses in operation, temporary changes in the concentration can occur. Knowledge of the instantaneous values can be utilized in order to avoid improper dosaging of the chemicals to be added.

The following examples serve for further explanation of the invention:

EXAMPLE 1

In an arrangement in accordance with FIG. 2, using an embodiment of the invention (large specific surface of the copper parts in the metal-ion generator, high velocity of flow in the entire arrangement, conducting of the flow in such a manner that the oxidizing compounds of the redox compounds formed by oxidation at the anode cannot reach the cathode), a copper bath having the following composition was used:

80 g/liter copper sulfate ($CuSO_4.5H_2O$)

180 g/liter sulfuric acid, conc.

10 g/liter iron as ferrous sulfate ($FeSO_4.7H_2O$)

0.08 g/liter sodium chloride with the following brighteners:

1.5 g/liter polypropylene glycol 0.006 g/liter 3-mercaptopropane-1-sulfonic acid, sodium salt 0.001 g/liter N-acetylthiourea A current efficiency of 84% was determined. The consumption was determined over 100 amp hours/liter as:

| | |
|---|---|
| propyleneglycol | 3.3 g/kAh |
| 3-mercaptopropane-1-sulfonic acid sodium salt | 0.3 g/kAh |
| N-acetylthiourea | 0.04 g/kAh |

The elongation upon rupture of the deposited layers amounted to 17% at the end of the test.

EXAMPLE 2

The test of Example 1 was repeated in the arrangement shown in FIG. 3, the plating solution being conducted serially through the cathode and anode spaces. A current efficiency of 92% was obtained. The consumption, again determined over 100 amp hours/liter, was:

| | |
|---|---|
| propyleneglycol | 2.0 g/kAh |
| 3-mercaptopropane-1-sulfonic acid, sodium salt | 0.2 g/kAh |
| N-acetylthiourea | 0.02 g/kAh |

The elongation upon rupture was improved to 20%. In this test, the coated circuit boards passed a second soldering shock test (10 seconds at 288° C. soldering temperature) without cracks in the region of the holes. The deposition was uniformly shiny.

EXAMPLE 3

In a horizontal installation in accordance with FIG. 4, circuit boards were copper-plated in a plating solution of the following composition:

80 g/liter copper sulfate ($CuSO_4.5H_2O$)

200 g/liter sulfuric acid, conc.

8 g/liter iron as ferric sulfate ($Fe_2(SO_4)_3.9H_2O$)

0.06 g/liter sodium chloride

For brighteners, the following were added:

1.0 g/liter polypropylene glycol 0.01 g/liter 3-(benzthiazolyl-2-thio)-propylsulfonic acid, sodium salt 0.05 g/liter acetamide With an electrolyte temperature of 34° C., bright metal layers were obtained on a scratched copper laminate with a current density of 6 amps/$dm^2$. The circuit board metallized in this manner withstood five soldering shock tests (10 seconds at a soldering temperature of 288° C.). The current efficiency was 91.%. No problems arose in the handling (making up of the addition substances consumed) of the plating solution.

EXAMPLE 4 (COMPARISON EXAMPLE)

The test described in Example 1 was carried out in an electrolysis cell. The measures in accordance with the invention were not used, in particular not the feeding of the stream to the cathodes and anode in accordance with the invention.

At a temperature of the plating solution of 30° C., bright metal layers were obtained on scratched copper laminate surface with a current density of 4 amp/$dm^2$. The cathodic current efficiency was only 68%. The consumption of the additive compounds without entrainment of the plating solution by lifting the treatment material out of the bath container, averaged over 100 amp hours/liter, amounted to:

| | |
|---|---|
| propyleneglycol | 5 g/kAh |
| 3-mercaptopropane-1-sulfonic acid sodium salt | 1.6 g/kAh |
| N-acetylthiourea | 0.2 g/kAh |

The elongation upon rupture of the deposited layers was only 14% at the end of the test.

EXAMPLE 5 (COMPARISON EXAMPLE)

Copper layers were deposited on circuit boards in accordance with Example 1 after a substrate of copper had been previously deposited from the solution for a lengthy period of time (2000 amp hours/liter).

The circuit boards no longer withstood two soldering shock tests (10 seconds at a soldering temperature of 288° C.) without cracks. Furthermore, non-uniform copper layers were obtained. In Examples 1 to 3, copper layers with good to very good elongation upon rupture were deposited. The cathodic current efficiency and the consumption of the additive compounds which were added to the plating solution in order to control the physical-mechanical layer properties, were satisfactory. The appearance of the copper layers was excellent and withstood the use tests.

However, after lengthy loading of the plating solution upon the electrolytic deposition of copper, no suitable results were obtained any longer.

We claim:

1. A process for electrolytically depositing a uniform metal layer onto a workpiece, comprising the steps of:

immersing the workpiece serving as a cathode and an insoluble and dimensionally stable anode into a plating solution contained in an electrolytic container, the solution comprising (a) ions of the metal to be deposited onto the workpiece, (b) an additive substance for controlling physical-mechanical properties of the metal to be deposited and (c) an electro-chemically reversible redox couple;

forming an oxidizing compound by contacting the anode with the electro-chemically reversible redox-couple;

generating metal-ions by contacting the oxidizing compound with a metal-ion generator comprising a metal part of the metal to be deposited onto the workpiece;

controllably circulating the plating solution between the container and the metal-ion generator to maintain a reaction between the oxidizing compound and the metal part for forming metal ions, the plating solution being controlled at least one of to directly flow from the cathode to the anode and from the anode to the metal-ion generator, and to flow in part directly from the cathode to the metal-ion generator, while preventing backflow of the plating solution from the anode to the cathode; and minimizing a concentration of the oxidizing compound in the direct vicinity of the cathode.

2. The process according to claim 1, wherein the minimizing step includes minimizing the concentration of oxidizing compound in the direct vicinity of the cathode to less than about 0.015 moles/liter.

3. The process according to claim 2, further comprising the step of:

circulating the plating solution to the anode and thereafter to the metal-ion generator with a high velocity of flow.

4. The process according to claim 2, further comprising the step of:

introducing at least one second oxidizing compound into the metal-ion generator.

5. The process according to claim 4, wherein the second oxidizing compound is oxygen.

6. The process according to claim 2, further comprising the step of:

separating a portion of the plating solution from the vicinity of the cathode and circulating the portion directly to the metal-ion generator, bypassing the anode.

7. The process according to claim 2, further comprising the step of:

directing the circulating plating solution coming from the metal-ion generator directly to the cathode, followed by directing the solution to the anode.

8. The process according to claim 1, further comprising the step of:

maintaining a concentration of compounds of the electro-chemically reversible redox couple at a concentration value which lies below a value necessary to supply metal ions for depositing a uniform metal layer onto the workpiece.

9. The process according to claim 8, wherein the metal part in the metal-ion generator has a surface area so that the concentration of the oxidizing compounds is lowered to a value of about zero upon circulation through the metal-ion generator.

10. An apparatus for the electrolytic deposition of uniform layers of metal, comprising:

a workpiece serving as a cathode;

at least one insoluble, dimensionally stable anode;

an electrolytic container adapted to hold a plating solution;

a metal-ion generator connected to the electrolytic container;

the cathode and the at least one anode being disposed in the electrolytic container and adapted to be in contact with the plating solution;

the at least one insoluble, dimensionally stable anode being disposed in close vicinity to the metal-ion generator;

means for feeding the plating solution first to the cathode and then from the cathode one of to the at least one anode and directly to the metal-ion generator;

first transfer means for transferring the plating solution fed to the at least one anode to the metal-ion generator, the feeding means and the first transfer means being configured to prohibit backflow of the plating solution from the anode to the cathode; and second transfer means for transferring the plating solution from the metal-ion generator into the electrolytic container.

11. An apparatus according to claim 10, wherein the metal is copper.

12. The apparatus according to claim 10, wherein the first transfer means is a high velocity suction means for drawing off the plating solution present in the vicinity of the at least one anode to the metal-ion generator.

13. The apparatus according to claims 12, further comprising at least one ion-permeable partition wall for dividing the electrolyte container.

14. The apparatus according to claim 13, further comprising at least one outlet for removing the plating solution from the vicinity of the cathode and guiding the plating solution to the metal-ion generator.

15. The apparatus according to claim 14, wherein the metal-ion generator comprises a first container and a second container, the first container having an open top for receiving metal parts, a bottom with a mixing chamber disposed therein for introducing circulated plating solution from the vicinity of the anode, the first container is connected to the second container by an overflow pipe, and the second container is adapted to hold plating solution discharged from the overflow pipe.

16. The apparatus according to claims 15, wherein the first container of the metal-ion generator comprises downwardly inclined plates for preventing compacting of the metal supply.

17. The apparatus according to claims 16, further comprising air supply lines connected to the mixing chamber of the first container to provide oxygen to the plating solution.

18. The apparatus according to claims 16, further comprising clamping means for holding, electrically contacting, and moving the workpiece through the plating solution.

19. A process for electrolytically depositing a uniform metal layer onto a circuit board, comprising the steps of:

connecting the circuit board as a cathode in an electrolytic circuit;

providing at least two insoluble and dimensionally stable anodes;

immersing the circuit board and the anodes into a plating solution contained in an electrolytic container, the solution comprising (a) metal ion, (b) an additive substance for controlling physical-mechanical properties of the metal and (c) an electro-chemically reversible redox couple forming oxidizing compounds when contacting the anode;

generating metal-ions by contacting the oxidizing compound with a metal-ion generator comprising a metal piece of the metal to be deposited;

circulating the plating solution between the container and the ion generator for maintaining a reaction between the oxidizing compounds and the metal piece for forming metal ions, the plating solution being circulated to flow from the cathode to the anode to the metal-ion generator, and selectively in part directly from the cathode to the metal-ion generator, while preventing backflow of the plating solution from the anode to the cathode; and controllably re-circulating the plating solution into the container for minimizing a concentration of the oxidizing compounds in the direct vicinity of the circuit board.

* * * * *